US011718452B2

(12) United States Patent
Diaz Cirauqui

(10) Patent No.: US 11,718,452 B2
(45) Date of Patent: Aug. 8, 2023

(54) STOPPER HOLDER DEVICE FOR BOTTLES AND THE LIKE

(71) Applicant: OIOKY DRINKS, S. L., Donostia (ES)

(72) Inventor: José Javier Diaz Cirauqui, Donostia (ES)

(73) Assignee: OIOKY DRINKS, S. L., Donostia (ES)

( * ) Notice: Subject to any disclaimer, the term of this patent is extended or adjusted under 35 U.S.C. 154(b) by 0 days.

(21) Appl. No.: 17/068,047

(22) Filed: Oct. 12, 2020

(65) Prior Publication Data

US 2021/0024259 A1 Jan. 28, 2021

Related U.S. Application Data

(63) Continuation of application No. PCT/ES2019/070240, filed on Apr. 9, 2019.

(30) Foreign Application Priority Data

Apr. 25, 2018 (ES) ..... ES201830595U

(51) Int. Cl.
*B65D 45/06* (2006.01)

(52) U.S. Cl.
CPC ..... *B65D 45/06* (2013.01)

(58) Field of Classification Search
CPC ..... B65D 45/06; B65D 39/0082; B65D 39/0035; B65D 2251/1058;
(Continued)

(56) References Cited

U.S. PATENT DOCUMENTS

| | | | |
|---|---|---|---|
| 8,967,414 | B2 | 3/2015 | Lane |
| 2012/0091160 | A1 | 4/2012 | Rognard |
| 2017/0190480 | A1 | 7/2017 | Liberati |

FOREIGN PATENT DOCUMENTS

| | | | |
|---|---|---|---|
| BE | 406460 | A | 11/1934 |
| CN | 106536367 | A | 3/2017 |

(Continued)

OTHER PUBLICATIONS

International Search Report and Written Opinion received in International Application No. PCT/ES2019/070240, dated Oct. 2, 2019 (13 pages).

(Continued)

*Primary Examiner* — Anthony D Stashick
*Assistant Examiner* — Lauren Kmet
(74) *Attorney, Agent, or Firm* — Edell, Shapiro & Finnan, LLC

(57) ABSTRACT

A stopper holder device for bottles is provided that includes a base-part associated with a bottle neck, a latch articulated in the base-part respect to which can swing, and a bracket which supports the stopper and which is articulated at the latch. The base-part includes an elastically deformable portion with means to release the elastically deformable portion from the bottle neck when causing an elastic deformation on the deformable portion, or to embrace the portion to the neck of the bottle when not causing the elastic deformation, so that the same stopper can be used in different bottles. The base-part also includes first structures, where the latch is articulated, and slots for housing wings of the bracket when the bottle is closed. The bracket includes second structures to which the latch is swingly attached. The latch includes third structures cooperating with the first structures and fourth structures cooperating with the second structures.

18 Claims, 6 Drawing Sheets

(58) Field of Classification Search
CPC ..... B65D 2251/1075; B65D 45/16; B65D 45/025; B65D 45/34; B67B 1/08; B67B 1/00
See application file for complete search history.

(56) References Cited

FOREIGN PATENT DOCUMENTS

| | | | |
|---|---|---|---|
| DE | 52560 | C | 6/1890 |
| DE | 8226689 | U1 | 11/1982 |
| FR | 346672 | A | 2/1905 |
| FR | 1149352 | A | 12/1957 |

OTHER PUBLICATIONS

India Examination Report, dated May 26, 2022, 5 pages.

STOPPER HOLDER DEVICE FOR BOTTLES AND THE LIKE

CROSS-REFERENCE TO RELATED APPLICATIONS

The present application relates to and claims the benefit and priority to International Application No. PCT/ES2019/070240, filed Apr. 9, 2019, which relates to and claims the benefit and priority to Spanish Utility Application No. U201830595, filed Apr. 25, 2018.

TECHNICAL FIELD

The invention relates to a stopper holder device which, when incorporated on a bottle neck, maintains at all times the bottle with a stopper and allows to both cover and uncover the bottle at any time that it is necessary.

The stopper holder device is universally applicable, both in bottles and in similar containers (for example jars). Regardless of the type of stopper or container where it is applied, the stopper and the container are permanently related to each other, without requiring a particular conformation in the neck of the bottle to produce this permanent relationship.

BACKGROUND

In the current state of the art stopper assemblies are known that are attachable to the neck area of bottles. The stopper assemblies include a stopper and an associated mechanism by which the bottles are closed or opened while keeping the stopper related at all times with the bottle, and enabling both closing and opening the bottle as many times as necessary without separating the stopper assembly from the bottle. Classic bottles of soda or beer are clear examples.

A problem with these known devices is that they require some adaptation to the bottles to hold it. These adaptations are made by the manufacturer of the bottle, which means that each bottle uses its own holder and stopper. That is, it is not possible to change them later or use these stopper assemblies on other bottles that have not been particularly adapted for use with the stopper assemblies.

An additional problem is that known stopper assemblies, with their built-in supports, do not allow for the recycling of bottles without having previously removed them (which, in practice, makes recycling unfeasible as such withdrawal involves breaking the bottle, or at least its neck, with the consequent risk of accidental cuts).

SUMMARY

Disclosed is a stopper holder device that can be incorporated onto the neck of bottles or similar containers to maintain the stopper coupled at all times with the corresponding bottle or container. The stopper holder device includes a base-part associated with the neck of the bottle or container neck, a latch coupled to the base-part in an articulated/pivoting manner so that it can swing with respect to the base-part, and a bracket which supports the stopper, the bracket being coupled to the latch in an articulated/pivoting manner.

The base-part comprises:

an elastically deformable portion that includes means to release it from the neck of a bottle when causing an elastic deformation, or to embrace the elastically deformable portion to the neck of the bottle when not causing the elastic deformation, so that the same stopper can be used in different bottles, without configuration or prior specific conformation in the neck of the bottle.

a first structure where the latch is articulated, and housings which house a portion of the bracket when the bottle is closed.

The bracket holds the stopper and comprises second structures that coupled the bracket to the latch with the possibility of swing.

The latch comprises third structures cooperating with the first structures of the base-part where it is articulated, and fourth structures cooperating with the second structures of the bracket where it is articulated.

It is basic for the purposes of the invention that the base-part can be mounted and removed from a variety of neck configurations.

It is also basic for the purposes of the invention that the assembly/disassembly of the stopper assembly from one bottle to another can be done in a non-destructive way. It is not necessary that the bottle or container possess any particular structure or notch in the bottle or container or in the neck of the bottle or container, to be able to fix the stopper holder device to the bottle or container.

The basic structure of the holder device allows it to be attached and removed from a bottle. The support structure may comprise a one-piece construction or a multi-piece construction. The latch may comprise a one-piece or a multi-piece construction.

These and other advantages and features will become apparent in view of the figures and the detailed description.

BRIEF DESCRIPTION OF THE DRAWINGS

The accompanying figures depict preferred embodiments and are not intended to limit the scope of the invention.

DETAILED DESCRIPTION

Described below are non-limiting preferred embodiments of stopper holder devices for bottles and the like. The stopper holder devices include a base-part 1, a latch 3 articulated with base-part so that it can swing/pivot with respect to the base-part; and a bracket configured to support a stopper 16, the bracket being articulated at the latch 3.

Figure 3:
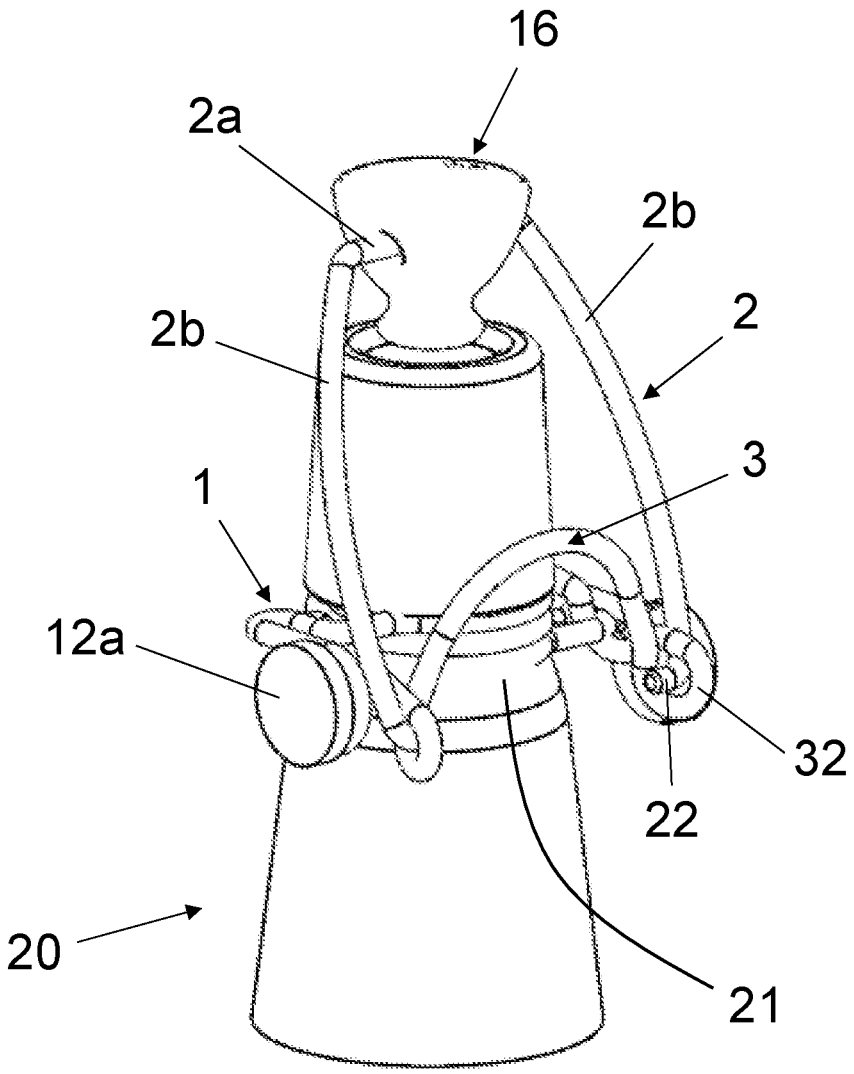
FIG. 3 is a schematic view of the stopper holder device of FIG. 1 attached to the neck of a bottle with the stopper being ready for being fitted inside the bottle.

The base-part 1 is capable of cooperating, for example, with the neck 21 of a bottle 20. The base-part includes an elastically deformable portion 11 in the form of a spiral rod. Coupled to the spiral rod are force applicators 12*a* and 12*b* that can be acted on to move towards one another to cause an enlargement of an area 15 bounded by the spiral rod. In this way, the stopper holder device may be released from the neck 21 of the bottle 20 when the elastically deformable portion is deformed. When no force is applied to the force applicators 12*a* and 12*b*, the elastically deformable portion 11 embraces the neck 21 to secure the stopper holder device to the neck as shown in FIG. 3. According to one embodiment, the area 15 is circular.

The base-part 1 also includes first structures 13 where the latch 3 is articulated, and slots 14 which house portions of the bracket 2 when the bottle is closed by the stopper 16.

The bracket 2 supports the stopper 16 and includes second structures 22 that are coupled with the latch 3 with the possibility of swing/pivoting.

The latch 3 includes third structures 31 cooperating with the first structures 13 of the base-part 1 where it is articulated. The latch 3 also includes fourth structures 32 cooperating with the second structures 22 in an articulated/pivoting manner.

According to one embodiment, the force applicators 12*a* and 12*b* comprise widen parts or heads facing one another in the base-part 1 itself. The area 15 bounded by the spiral rod widening when the spiral rod is elastically deformed by applying opposite forces to the force applicators. The widening of the area 15 allows a releasing of the stopper holder device from the neck 21 of the bottle 20. The area 15 decreasing when ceasing the force exerted on the heads or widen parts 12*a* and 12*b* so that the elastically deformable portion 11 embraces the neck 21.

Figure 1:
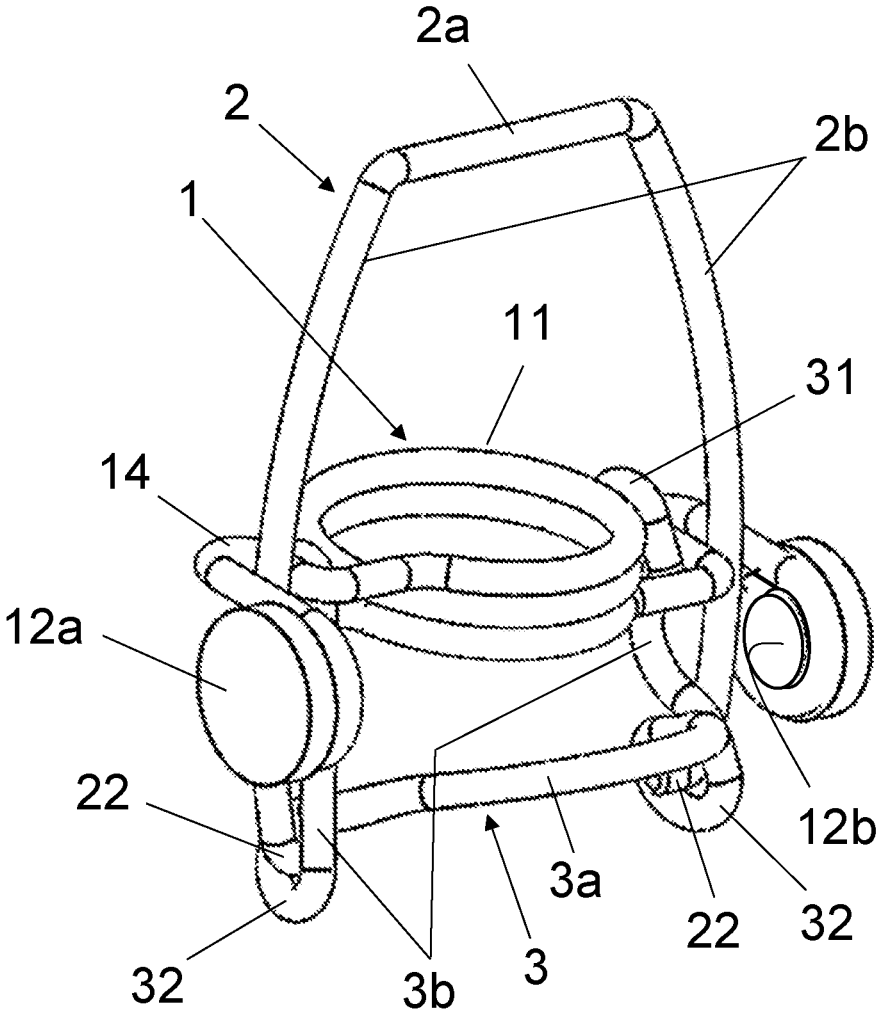
FIG. 1 is a schematic perspective view of a stopper holder device (excluding the stopper).

In the embodiment of FIGS. 1 and 2, the bracket 2 is a one-piece structure having a "U" configuration, with the stopper 16 being allocated on a base 2*a* of the bracket 2 and the second structures 22 being disposed at the free ends of wings 2*b* of the bracket 2. For each end of the base 2*a* extends a wing 2*b*, as shown in FIG. 1.

In the embodiment of FIGS. 1 and 2, the latch 3 is a one-piece structure having a "U" configuration, with the third structures 31 being located at the free ends of wings 3*b* of the latch 3 and the fourth structures 32 being located at the confluence of the wings 3*b* with a base 3*a* of the latch 3.

Figure 4:
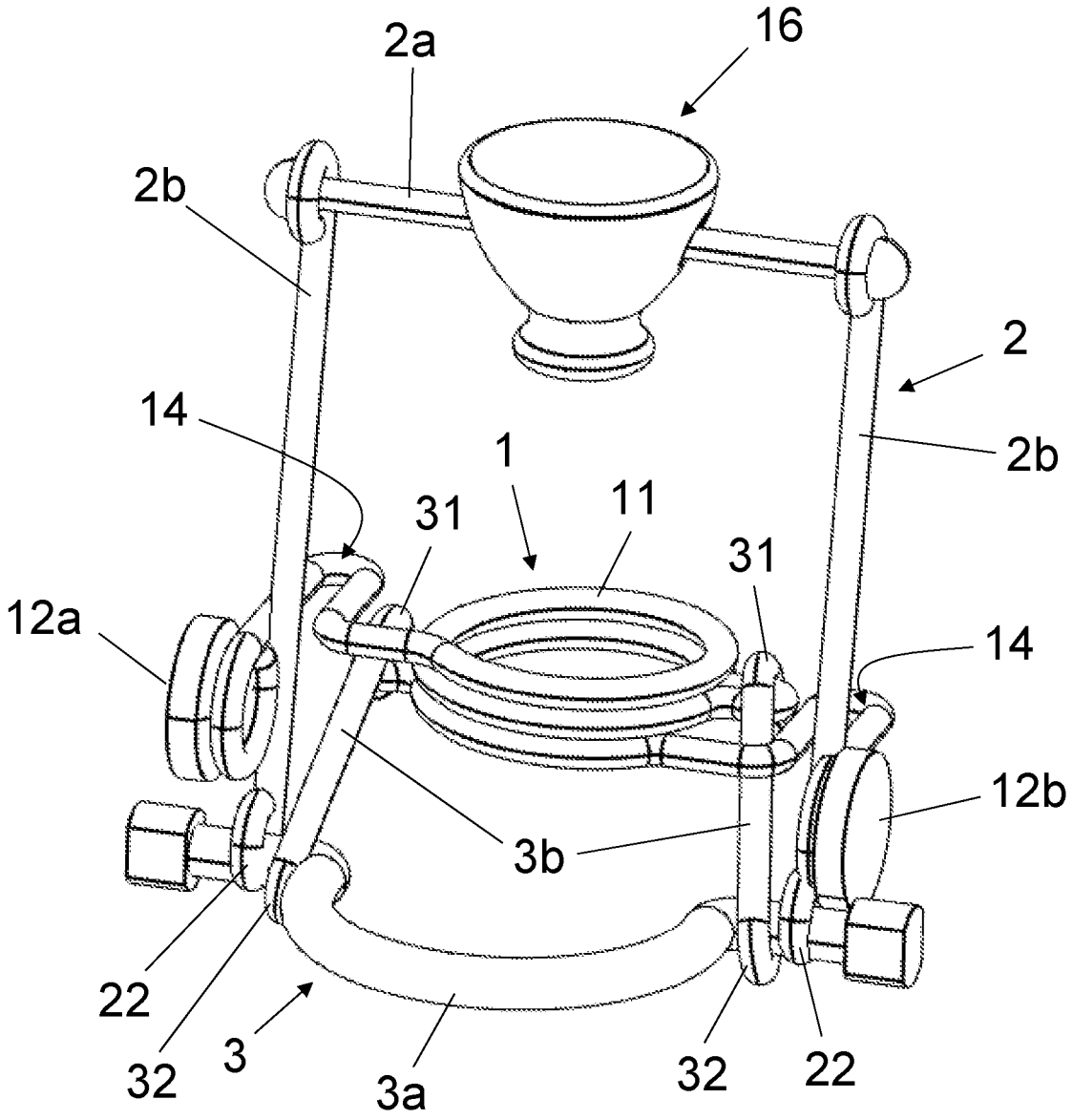
FIG. 4 is a schematic perspective view of a stopper holder device according to another embodiment with the stopper being fixed to the bracket.

In the embodiment of FIG. 4, the bracket 2 has a multi-piece structure with the base 2*a* and wings 2*b* being independent pieces.

In the embodiment of FIG. 4, the latch 3 is also a multi-piece structure with the base 3*a* and 3*b* wings being separate pieces.

In any of the embodiments described, a portion of each wing 2*b* of the bracket 2 is housed in a corresponding slot 14 of the base-part 1 when the bottle is closed by the stopper 16, as shown in FIG. 1. The slots 14 of the base-part 1 are U-shaped housings and are configured to receive corresponding wings 2*b* of the bracket 2, the slots 14 being arranged opposite to each other.

Figure 2A:
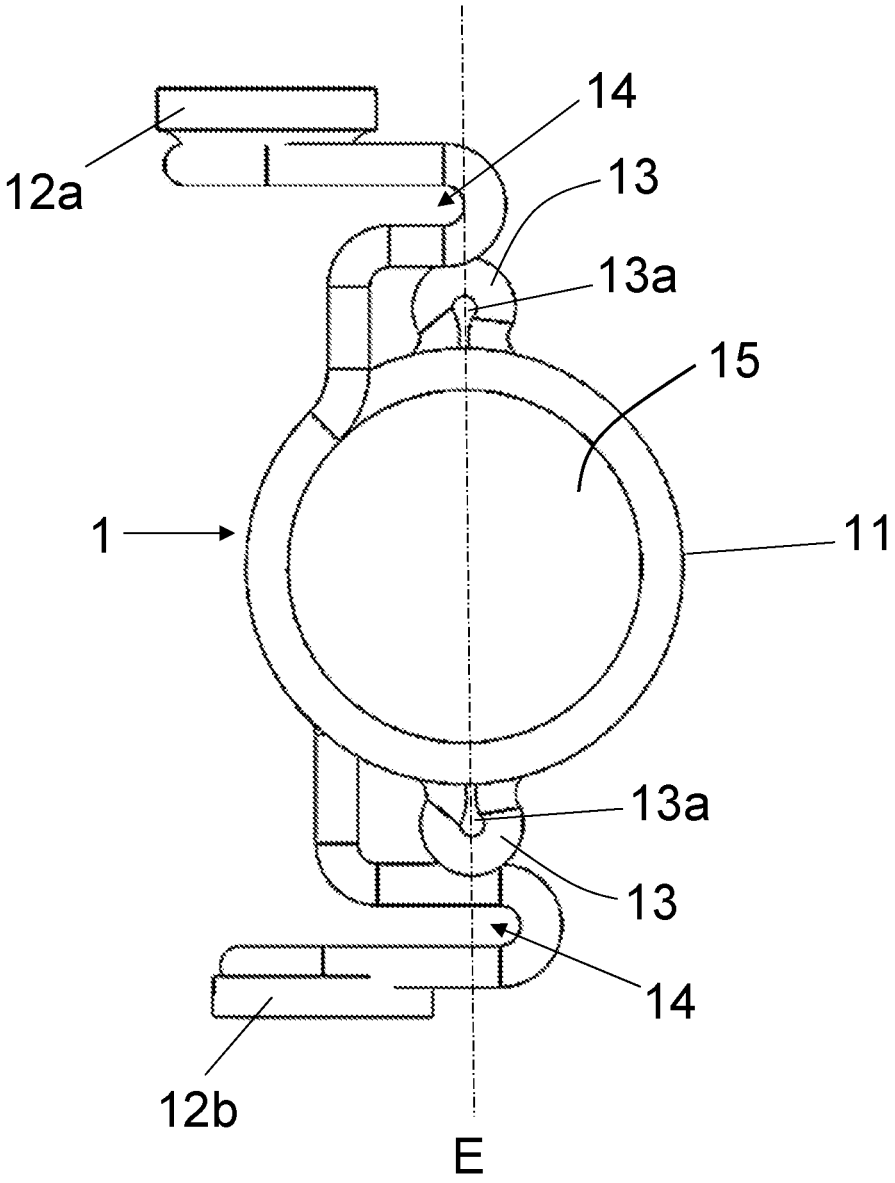
FIG. 2A is a schematic plant view of the base-part of the stopper holder device of FIG. 1.
Figure 2B:
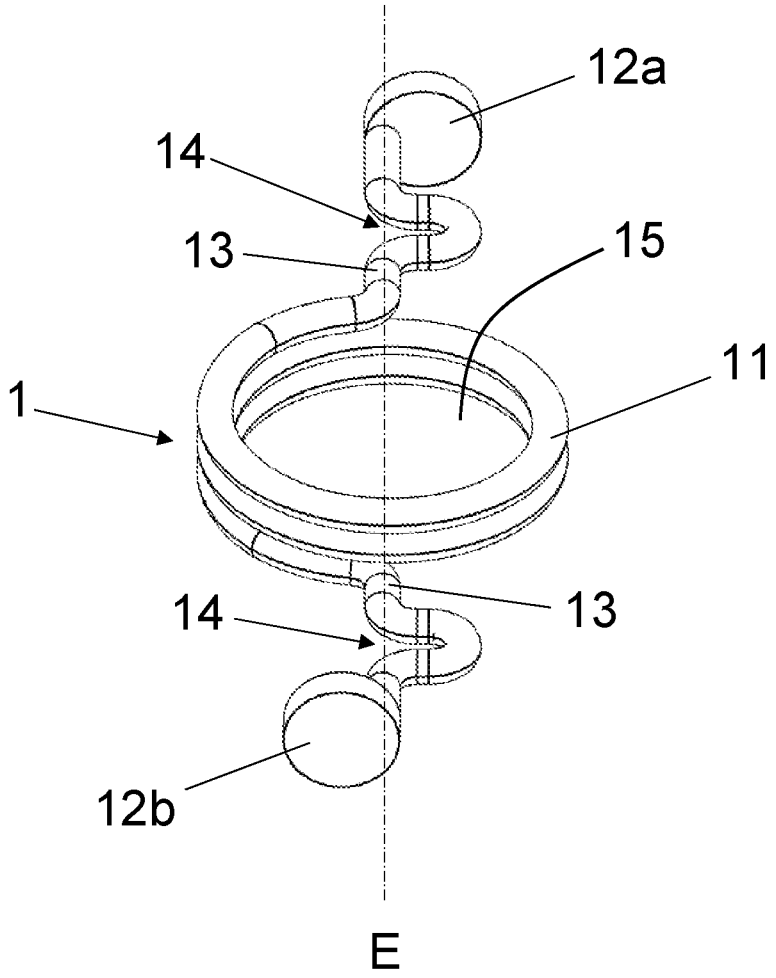
FIG. 2B is a perspective view of the base-part of the stopper holder device according to another embodiment.
Figure 2C:
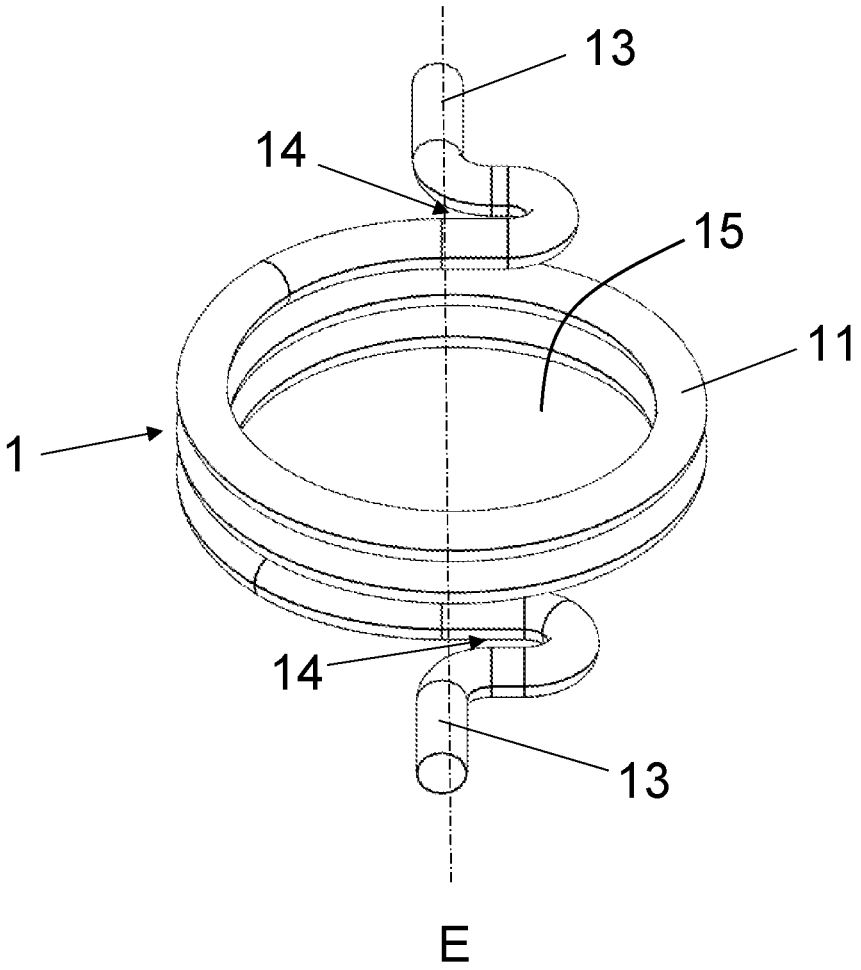
FIG. 2C is a perspective view of the base-part of FIG. 2B without the force applicators.

The first structures 13 of the base-part 1 of the stopper holder device include at least two structures arranged diametrically opposite one another, each of the first structures 13 protruding from the outside diameter of the elastically deformable portion 11, as shown in FIGS. 2A, 2B and 2C. The first structures 13 may be arranged at the same level or at different levels.

The first structures 13 are arranged on axes parallel to an axis "E" passing through the center of the middle plane of the elastically deformable portion 11. As noted above, the elastically deformable portion 11 comprises a spiral, the middle plane being a plane passing through the half height of the spiral.

In the embodiment of FIG. 2A, the first structures 13 of the base-part 1 comprise two lugs or tongues so that in the interior of each lug or tongue a housing 13*a* is formed, which allows to fix with the possibility of swing a corresponding third structure 31 of the latch 3. The lugs or tongues are arranged at different levels, i.e. at different height, although it would also be possible to arrange them at the same height.

In the embodiment of FIG. 2B or 2C, the first structures 13 of the base-part 1 comprise two linear extensions, arranged diametrically opposite, so that a corresponding third structure 31 of the latch 3 is fixed in a respective linear extension with the possibility of swing.

As shown in FIGS. 2B and 2C, the different diametrically opposed assemblies, formed by a respective slot 14 and a respective linear extension 13, are arranged at different levels, i.e. at different heights. For example, a slot housing 14 and a linear extension 13 are arranged at the level of the lower spiral of the spiral rod and the other slot 14 and the other linear extension 13 are arranged at the level of the upper spiral of the spiral rod. Therefore, the wings 3*b* of the latch 3 may comprise different lengths.

In the embodiments of FIGS. 2B and 2C, a slot 14 and a respective linear extension 13 are arranged aligned, i.e. at the same height and one following the other. In the example of FIG. 2B, the linear extension 13 is arranged in a linear position prior to a respective slot 14 and in the example of FIG. 2C, the linear extension 13 is arranged in a linear rear position to the respective slot 14.

To facilitate the interaction between the third structures 31 of the latch 3 and the first structures 13 of the base-part 1 according to any of the described embodiments, each of the third structures 31, where a structure 31 for each first structure 13 of the base-part 1 is arranged, comprises a hook-shaped structure, which favors the assembly of the latch 3 in the base-part 1 and allows the latch 3 to swing with respect to the first structures 13 of the base-part 1.

There may be variable materials, dimensions, proportions and, in general, those other incidental or secondary details which do not alter, change or modify the design essentiality proposed.

What is claimed is:

1. A stopper holder device for a container comprising:

a base-part having an elastically deformable portion configured to engage with and disengage with container necks of different sizes and shapes, the elastically deformable portion bounding an area that increases when the elastically deformable portion is deformed;

a first force applicator coupled to a first side of the elastically deformable portion and a second force applicator coupled to a second side of the elastically deformable portion, the first and second force applicators and elastically deformable portion being configured such that when the first and second force applicators are moved towards one another, the area increases, the first and second force applicators and elastically deformable portion being configured such that when the first and second force applicators are thereafter moved away from each other, the area decreases;

a latch pivotably coupled to the base-part; and a bracket configured to support a stopper, the bracket pivotably couple to the latch and including first and second wings;

the base-part including first and second slots respectively located on the first and second sides of the elastically deformable portion that are respectively configured to receive a portion of the first and second wings of the bracket.

2. The stopper holder device according to claim 1, wherein the area is circular.

3. The stopper holder device according to claim 1, wherein the elastically deformable portion comprises a spiral rod.

4. The stopper holder device according to claim 1, wherein the bracket has a U-like configuration and includes a base and first and second wings, each of the first and second wings having a first end coupled to respective first and second sides of the base, each of the first and second wings having a second end that are each pivotably coupled to the latch.

5. The stopper holder device according to claim 4, wherein the latch has a U-like configuration and includes a base and first and second wings, each of the first and second wings of the latch having a first end coupled to respective first and second sides of the base of the latch, the first and second wings of the bracket respectively being pivotably coupled to the first and second wings of the latch.

6. The stopper holder device according to claim 5, wherein each of the bracket and latch comprises a one-piece structure.

7. The stopper holder device according to claim 1, further comprising a stopper fixed to the bracket.

8. The stopper holder device according to claim 1, wherein when the bracket is moveable to a first position corresponding to supporting the stopper in a closed position inside the container, the first and second wings of the bracket respectively reside in the first and second slots of the base-part.

9. The stopper holder device according to claim 1, wherein the base-part includes first and second protruding structures that are respectively disposed on diametrically opposite first and second sides of the base-part, the first and second protruding structures of the base-part protruding from an outside diameter of the elastically deformable portion, the latch being pivotably coupled to the first and second protruding structures of the base-part.

10. The stopper holder device according to claim 9, wherein the first and second protruding structures of the base-part are located at a same level.

11. The stopper holder device according to claim 9, wherein the first protruding structure of the base-part is located at a first level and the second protruding structure of the base-part is located at a second level different from the first level.

12. The stopper holder device according to claim 9, wherein the first and second protruding structures of the base-part are arranged parallel to one another.

13. The stopper holder device according to claim 9, wherein the first and second protruding structures of the base-part respectively comprise first and second tongues that respectively comprise first and second housings in an interior of the first and second tongues, the latch including third and fourth structures that respectively reside inside the first and second housings in the interior of the first and second tongues.

14. The stopper holder device according to 9, wherein the first and second protruding structures of the base-part respectively comprise first and second linear extensions.

15. The stopper holder device according to claim 14, wherein the first linear extension is arranged between the first slot of the base-part and the first side of the elastically deformable portion and the second linear extension is arranged between the second slot of the base-part and the second side of the elastically deformable portion.

16. The stopper holder device according to claim 14, wherein the first linear extension is arranged in a first linear rear position to the first slot of the base-part and the second linear extension is arranged in a second linear rear position to the second slot of the base-part.

17. The stopper holder according to claim 9, wherein the latch includes first and second hook shaped structures that are respectively pivotably coupled to the first and second protruding structures of the base-part.

18. The stopper holder device according to claim 1, wherein the first and second force applicators are heads located diametrically opposite one another.

* * * * *